US007913678B2

(12) United States Patent
Hudkins

(10) Patent No.: US 7,913,678 B2
(45) Date of Patent: Mar. 29, 2011

(54) RETRACTING CONTAINMENT ARROW REST

(75) Inventor: Jason M. Hudkins, Rochester, IN (US)

(73) Assignee: Olympic Archery LLC, Rochester, IN (US)

( * ) Notice: Subject to any disclaimer, the term of this patent is extended or adjusted under 35 U.S.C. 154(b) by 414 days.

(21) Appl. No.: 12/195,935

(22) Filed: Aug. 21, 2008

(65) Prior Publication Data

US 2009/0183720 A1 Jul. 23, 2009

Related U.S. Application Data

(60) Provisional application No. 61/022,543, filed on Jan. 22, 2008.

(51) Int. Cl.
*F41B 5/22* (2006.01)

(52) U.S. Cl. ..... 124/44.5; 124/1; 124/24.1; 124/25.7; 124/80; 124/86; 124/88

(58) Field of Classification Search ..... 124/1, 24.1, 124/25.7, 44.5, 80, 86, 88
See application file for complete search history.

(56) References Cited

U.S. PATENT DOCUMENTS 4,282,850 A * 8/1981 Warnicke ..... 124/24.1
4,351,311 A * 9/1982 Phares ..... 124/44.5
4,372,282 A * 2/1983 Sanders ..... 124/24.1
4,686,956 A * 8/1987 Troncoso, Jr. ..... 124/44.5
4,803,971 A * 2/1989 Fletcher ..... 124/44.5
4,858,589 A * 8/1989 Chang ..... 124/24.1
4,865,007 A * 9/1989 Saunders ..... 124/41.1
4,917,072 A * 4/1990 Chang ..... 124/41.1
4,979,309 A * 12/1990 Oligschlaeger ..... 33/265
5,025,773 A * 6/1991 Hintze et al. ..... 124/44.5
5,042,450 A * 8/1991 Jacobson ..... 124/44.5
5,181,502 A * 1/1993 Ray ..... 124/44.5
5,245,980 A * 9/1993 Colvin ..... 124/24.1
5,253,633 A * 10/1993 Sisko ..... 124/44.5
5,261,383 A * 11/1993 Halamay ..... 124/44.5
5,394,858 A * 3/1995 Karolian ..... 124/44.5
5,415,154 A * 5/1995 Angeloni ..... 124/44.5
5,419,303 A * 5/1995 Stewart ..... 124/44.5
5,456,242 A * 10/1995 Ruholl ..... 124/44.5
5,460,152 A * 10/1995 Specht ..... 124/44.5
5,460,153 A * 10/1995 Huntt ..... 124/44.5
5,526,800 A * 6/1996 Christian ..... 124/44.5
5,529,049 A * 6/1996 Antalosky ..... 124/44.5
5,603,309 A * 2/1997 Sheliga ..... 124/44.5
5,606,961 A * 3/1997 Basik et al. ..... 124/44.5
5,606,962 A * 3/1997 Troncoso ..... 124/44.5
5,685,287 A * 11/1997 Greywall ..... 124/44.5
5,855,200 A * 1/1999 Jessee ..... 124/44.5
5,915,369 A * 6/1999 Sheliga ..... 124/44.5
5,944,005 A * 8/1999 Schiff ..... 124/44.5
6,044,832 A * 4/2000 Piersons, Jr. ..... 124/44.5

(Continued)

*Primary Examiner* — Gene Kim
*Assistant Examiner* — Alexander R Niconovich
(74) *Attorney, Agent, or Firm* — Gerald E. Helget; Nelson R. Capes; Briggs and Morgan, P.A.

(57) ABSTRACT

An arrow rest that contains the arrow shaft before, during, and after the shot. To give the archer a precise, accurate shot, pull-away support fingers 120 degrees apart move in a self centering radial motion towards the center of the arrow shaft when the archer draws the bow to full draw and simultaneously pull away from the arrow shaft in a simultaneous radial motion to give complete clearance to the arrow shaft and its vanes or fletching once released from full draw.

7 Claims, 4 Drawing Sheets

U.S. PATENT DOCUMENTS 6,202,635 B1 * 3/2001 Evans ..... 124/44.5
6,363,924 B1 * 4/2002 Adams, Jr. ..... 124/44.5
6,557,541 B2 * 5/2003 Pinto, Jr. ..... 124/44.5
6,561,175 B1 * 5/2003 Tidmore ..... 124/44.5
6,591,823 B1 * 7/2003 Keller ..... 124/44.5
6,615,813 B1 * 9/2003 Troncoso et al. ..... 124/44.5
6,634,349 B2 * 10/2003 Mizek et al. ..... 124/44.5
6,662,796 B2 * 12/2003 St. Cyr ..... 124/44.5
6,681,753 B2 * 1/2004 Afshari ..... 124/44.5
6,742,511 B1 * 6/2004 Remme ..... 124/44.5
6,772,747 B1 * 8/2004 Vastag ..... 124/44.5
6,776,149 B1 * 8/2004 Beeks ..... 124/44.5
6,782,881 B2 * 8/2004 Mizek et al. ..... 124/44.5
6,789,535 B1 * 9/2004 McIntyre ..... 124/44.5
6,789,536 B1 * 9/2004 Summers ..... 124/44.5
6,792,932 B2 * 9/2004 Musacchia, Jr. ..... 124/44.5
6,814,068 B1 * 11/2004 Troncoso et al. ..... 124/44.5
6,823,856 B2 * 11/2004 Rager ..... 124/44.5
6,913,008 B2 * 7/2005 Simo et al. ..... 124/44.5
6,915,791 B2 * 7/2005 Harwath et al. ..... 124/44.5
6,948,488 B2 * 9/2005 Afshari ..... 124/44.5
6,994,080 B1 * 2/2006 Yoder ..... 124/44.5
7,165,543 B2 * 1/2007 Simo et al. ..... 124/44.5
7,219,662 B1 * 5/2007 Henry ..... 124/44.5
7,311,099 B2 * 12/2007 Rager ..... 124/44.5
7,331,338 B2 * 2/2008 Mizek ..... 124/44.5
7,337,773 B2 * 3/2008 Simo et al. ..... 124/44.5
7,409,950 B2 * 8/2008 Ellig et al. ..... 124/44.5
7,597,095 B2 * 10/2009 Grace et al. ..... 124/44.5
2002/0059926 A1 * 5/2002 Pinto, Jr. ..... 124/44.5
2003/0024516 A1 * 2/2003 Mizek et al. ..... 124/44.5
2003/0062034 A1 * 4/2003 Proctor ..... 124/44.5
2003/0127083 A1 * 7/2003 Musacchia, Jr. ..... 124/44.5
2003/0192520 A1 * 10/2003 Afshari ..... 124/35.2
2004/0134474 A1 * 7/2004 Graf ..... 124/44.5
2004/0139953 A1 * 7/2004 Harwath et al. ..... 124/44.5
2005/0011506 A1 * 1/2005 Afshari ..... 124/44
2005/0126554 A1 * 6/2005 Minica et al. ..... 124/44.5
2005/0139201 A1 * 6/2005 Nagle ..... 124/44.5
2005/0172945 A1 * 8/2005 Rager ..... 124/24.1
2005/0252499 A1 * 11/2005 Simo et al. ..... 124/44.5
2006/0011182 A1 * 1/2006 Simo et al. ..... 124/24.1
2006/0011189 A1 * 1/2006 Simo et al. ..... 124/86
2006/0027222 A1 * 2/2006 Yoder ..... 124/44.5
2007/0221186 A1 * 9/2007 Grace et al. ..... 124/44.5
2008/0105244 A1 * 5/2008 Rager ..... 124/44.5
2008/0168971 A1 * 7/2008 Mizek et al. ..... 124/44.5
2008/0173290 A1 * 7/2008 Harwath et al. ..... 124/44.5
2008/0216807 A1 * 9/2008 Troncoso ..... 124/88
2010/0006079 A1 * 1/2010 Harwath et al. ..... 124/44.5
2010/0175675 A1 * 7/2010 Roberts et al. ..... 124/25.6

* cited by examiner

RETRACTING CONTAINMENT ARROW REST

CROSS-REFERENCE TO RELATED APPLICATION

The present application is based on and claims the benefit of U.S. provisional patent application Ser. No. 61/022,543, filed Jan. 22, 2008, the content of which is hereby incorporated by reference in its entirety.

FIELD OF THE INVENTION

This invention is an accessory for an arrow to rest in with an archery bow that is held vertically or horizontally. The rest has radial self centering moving support fingers that move in together and support the arrow shaft in a complete 360 degrees circumference. The support fingers move in simultaneously when the bow is drawn to completely support the shaft's diameter. The rest rapidly pulls away from the arrow when the arrow is released so that the fletching does not contact the rest. Once the arrow is loaded it cannot fall out the bottom, left, or night sides. Once the bow is drawn back, the arrow is fully contained or confined within the rest because the support fingers completely contact the arrow 360 degrees with zero contact to the arrow and fletching and/or vanes on the arrow's release.

BACKGROUND OF THE INVENTION

The archery sport, whether hunting, bow fishing, or competitive archery, has many accessories to give the archer and his or her equipment an improved level of accuracy when shooting the bow. Arrow rests are needed to raise the arrow off the riser to give the arrow clearance above the arrow riser shelf and hand grip area to enable the fletching, vanes or numerous types of arrow points to pass over the shelf without contact or interference when the arrow is pulled back in the draw cycle of the bow string and then released. The arrow rest also forces the arrow to move in a straight linear motion from the knock point of the arrow to the release point or center of the arrow rest.

There are many designs for arrow rests on the market called drop away rests. Their function is as follows: once the arrow is drawn back, the arrow lifts off the arrow shelf and once the archer releases the arrow from full draw, the rest drops out of the way in a pivoting rotation or vertical dropping motion to get out of the way of the fletching or vanes if the rest reacts fast enough. U.S. Pat. Nos. 6,044,832; 5,415,154; 4,865,007: 4,803,971; and 7,311,099 are herein incorporated by reference.

To insure improvements of the current arrow rests that are on the market today there are many changes needed. Three of the problems that the current designs face are: the ability to contain the arrow to enable the archer to shoot at numerous angles; to be actuated fast enough to clear the arrow's vanes and fletching once the arrow is released; and third, once the rest drops out of the way it can bounce back into the flight path of the arrow when the archer releases the arrow due to recoil and or spring back in the apparatus itself. The present invention solves these problems.

First, most of the current drop-away arrow rests do not fully contain the arrow, but only support the arrow against the force of gravity. Thus, if the archer needs to move the bow to a position other than vertical, the arrow may drop off the rest, causing potential injury to the archer if the arrow is inadvertently released.

Second, many of the current rests do not actively release from the arrow, but depend on the force of gravity to allow the rest to passively drop away from the arrow upon firing. These rests may not be able to move away from the arrow fast enough to allow the fletching to clear the arrow rest.

Third, many of the current arrow rests require other accessories, such as a cable guard, for operation and cannot be used without these additional accessories. An example is the arrow rest described in U.S. Pat. No. 6,044,832.

Fourth, some of the rests bias the arrow support toward the arrow, depending on the relative movement of the bow limb, cable or string upon release to jerk the arrow support out of the path of the arrow, and then depend upon the restoring force of the spring to return the arrow support to a position where an arrow can again be loaded. An example is the arrow rest described in U.S. Pat. No. 4,803,971. Such arrow rests are unnecessarily complex and may cause the arrow rest to rebound into the path of the arrow.

There is a need for a pull-away arrow rest that completely supports an arrow around the perimeter of the arrow shaft when the bow is fully drawn and retracts rapidly and completely away from the path of the arrow shaft and vanes in a self-centering, radial motion.

SUMMARY OF THE INVENTION

An arrow rest that contains the arrow shaft before, during, and after the shot. To give the archer a precise, accurate shot, pull-away support fingers 120 degrees apart move in a self centering radial motion towards the center of the arrow shaft when the archer draws the bow to full draw and simultaneously pull away from the arrow shaft in a simultaneous radial motion to give complete clearance to the arrow shaft and its vanes or fletching once released from full draw.

A principle object and advantage of the arrow rest of the present invention is that the support fingers will not bounce or spring back into the flight of the arrow shaft, vanes or fletching due to recoil or spring from the apparatus itself.

Another principle object and advantage of the present invention is to enable the archer to shoot the bow from a vertical 90 degree, horizontal minus 90 degree or horizontal plus 90 degree position, the horizontal positions being achieved with the self centering radial motion of the support fingers moving in simultaneously to support the entire shaft's radius.

Another principle object and advantage of the present invention is that the self centering radial moving support fingers are actuated using the linear motion of the bow string or cable connected to the rest with the use of a rope, string, elastic string, cable, or rigid arm that will not slip and is tied or anchored to the string or cable with a knot, clamp, wrap or weaved method to ensure no slipping can occur once mounted to the string or cable.

Another principle object and advantage of the present invention is that the support fingers surround the arrow shaft 120 degrees apart with all support fingers moving in a self centering radial linear motion. This motion lifts the arrow and captures the arrow fully to ensure a straight line from the knock point to the center of the arrow rest. Once the arrow is released, the connection device or string moves back towards the actuator or pull arm to release the rest to the relaxed position. This motion releases the support fingers simultaneously in a complete radial linear motion to allow the arrow's shaft, vanes, or fletching to pass thru the rest without contact.

Another object and advantage of the present invention is that the arrow rest incorporates vertical up and down, horizontal left and right, forward, and backward adjustment mounts that mount the rest to the bow riser with the use of fasteners.

Another object and advantage of the present invention is that it also has fine adjustment mechanisms to limit the open diameter and closed diameter to accommodate different diameter arrow shafts.

Another object and advantage of the present invention is that the actuator arm has the ability to be loosened to adjust the rotation of the arm, thus adjusting the timing of the string or cable to the rest movement.

Another object and advantage of the present invention is a biasing means to move the rest expediently to the relaxed position from the actuated position. The biasing means is preferably a spring. This spring can be a coiled torsion spring, a linear extension spring, or a compression spring. The spring can be affixed to the internal rotating drive cam, installed around the drive gear shaft, or connected to the rotating actuator arm to drive the support fingers from the actuated position to the relaxed position.

Another object and advantage of the present invention is that it uses a rotating cam method to move the support fingers in towards the arrow shaft in a self centering radial linear motion.

Another object and advantage of the present invention is that it uses drive pins mounted within the support fingers that follow rotation geometry of the internal cam to move to the actuated position and to the relaxed position.

Another object and advantage of the present invention is that it uses a rack and pinion method to drive the cam in a clockwise and counter clockwise rotation to drive the support fingers from the relaxed position to the actuated position and from the actuated position to the relaxed position.

Another object and advantage of the present invention is that it may include vibration and sound deadening devices to ensure quite and vibration free operation.

DETAILED DESCRIPTION OF THE PREFERRED EMBODIMENT

Figure 1:
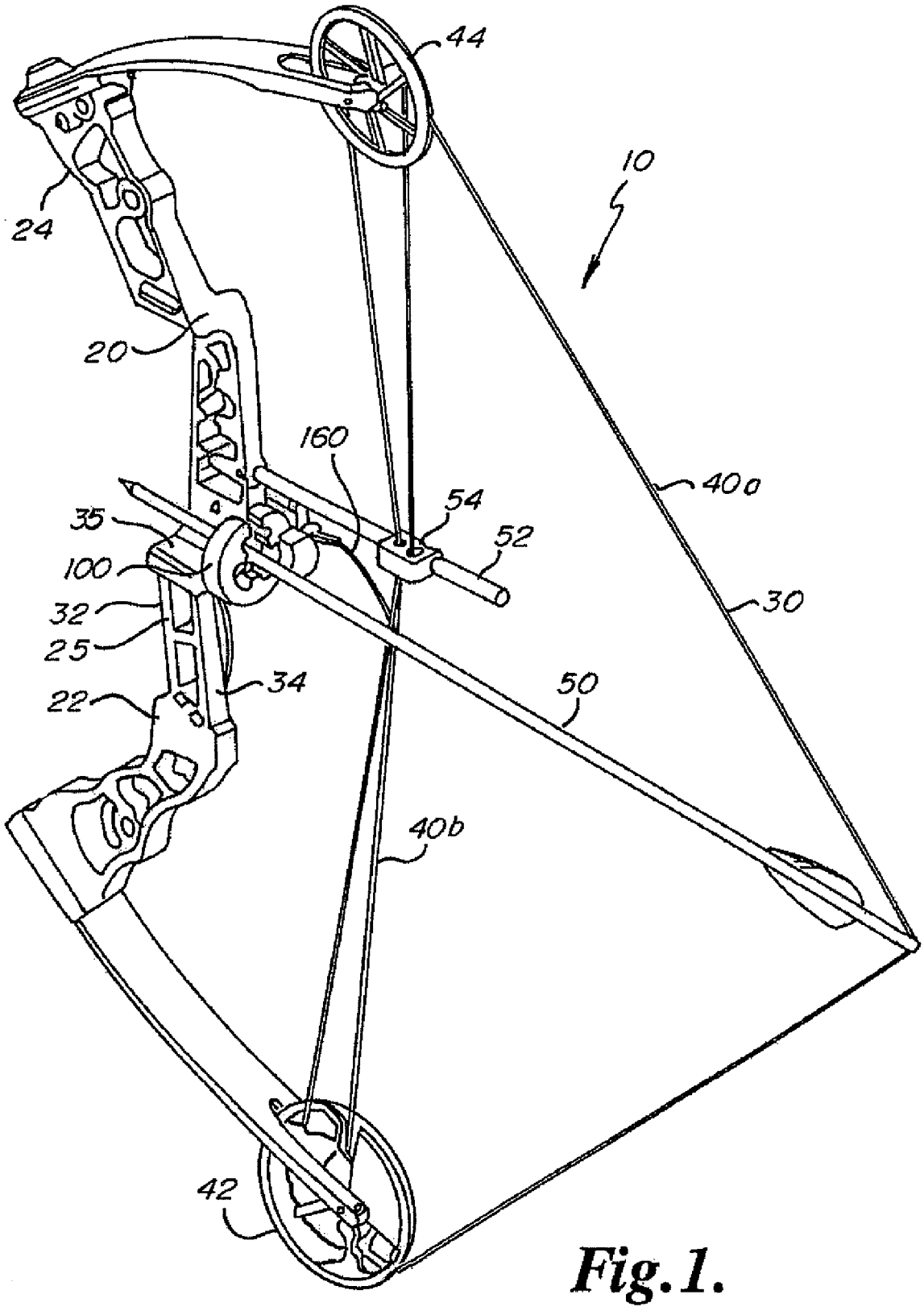
FIG. 1 is a rear perspective view of an archery bow with the present invention mounted thereon with an arrow at full draw position.

FIG. 1 illustrates an archery bow with the arrow rest 10 of the present invention attached thereto.

A compound bow 10 has a riser or frame 20 and a bow string 30. The riser 20 includes a lower portion 22 with a limb, an upper portion 24 with a limb, and a handle portion 25 with a grip (not shown) connected to and supporting the lower portion 22 and the upper portion 24. The handle portion 25 has a front surface 32 and an opposite real surface 34. During shooting with the bow, the front surface 32 is positioned facing the target and the back surface 34 is facing the archer. A ledge or shelf 35 is present above the handle portion 25.

The compound bow 10 has a pulley or cam 42 at the end of the lower portion 22 and a pulley or cam 44 at the end of the upper portion 24. The bowstring 30 extends between the cam 42 and the cam 44. The cams 42, 44 provide a mechanical advantage to the archer when drawing the bowstring 30.

The bowstring 30 includes at least two sections 40*a*, 40*b* extending between the cams 42, 44. Bowstring section 40*a* is the section on which an arrow is nocked. On some bows, bowstring section 40*b* is a cable. Mounted on the riser 20 above shelf 35 of the bow 10 is an arrow rest 100, which supports an arrow 50 while the archer is preparing to shoot.

While not necessary for the present invention, some compound bows 10 also have a cable guide 52 and a cable slide 54. As will be further described, the arrow rest 100 of the present invention operates either with or without the cable guide 52 and cable slide 54.

Figure 2:
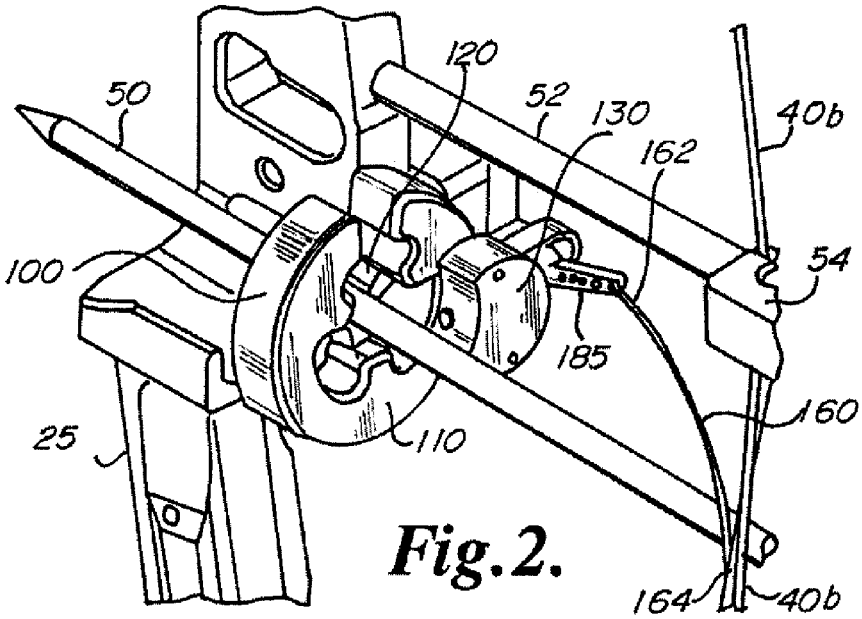
FIG. 2 is a detail of FIG. 1.

As generally illustrated in FIG. 2, the arrow rest 100 of the present invention comprises a round, circular or cylindrical support housing or case 110, with extendable and retractable support fingers 120 moving radially inwards and outwards from the support housing toward the arrow 50. Any number of support fingers 120 may be used, provided the support fingers cooperate to surround the arrow 50 around its circumference. Most preferably, three support fingers 120 are employed spaced 120 degrees apart. The term "fingers" does not necessarily limit the shape of the elements 120.

Again as generally illustrated in FIG. 2, the arrow rest 100 of the present invention further comprises a gear housing 130 adjacent to and preferably attached to the support housing 110. The gear housing 130 encloses and protects the gear mechanism 140, further described below, that actuates the movement of the support fingers 120. An actuator lever or arm 185 extends outwardly from the gear housing 130 and engages the gear mechanism 140.

Still examining FIG. 2, the arrow rest 100 of the present invention further comprises an actuator link 160 attached at one end 162 to the actuator lever or arm 185 and at an opposite end 164 to the bow string 30 or cable 40*b*. The actuator link 160 may be a rope, string, elastic string, cable, or rigid arm. The actuator link 160 could be rigidly connected to the cable slide 54.

Figure 3:
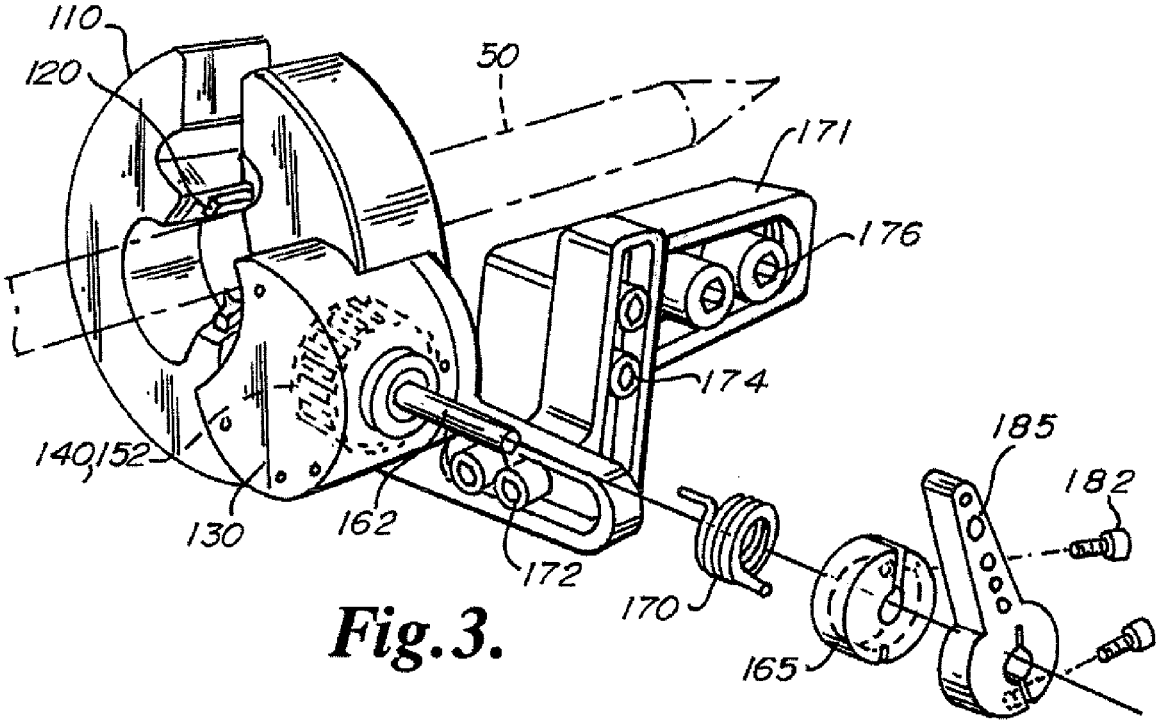
FIG. 3 is an exploded view of the arrow rest of the present invention with some internal structure shown in phantom.

Turning to FIG. 3, the arrow rest 100 of the present invention further comprises a mounting bracket 171 attached to the riser 20 of the bow, suitably by fasteners, screws or bolts (not shown). An adjustment portion 172 of bracket 171 allows the arrow rest 100 to be moved toward and away from the bow string 30. A second adjustment portion 174 allows the arrow rest 100 to be vertically moved toward either the lower arm 22 or the upper arm 24. A third adjustment portion 176 allows the arrow rest 100 to be moved laterally in a substantially horizontal plane relative to the handle portion 25, that is, toward or away from the cable guide 52 (if present).

Still referring to FIG. 3, which shows an exploded perspective view of the arrow rest 100, additional details may be appreciated. The gear mechanism 140 that actuates the movement of the support fingers 120 is shown in phantom as a pinion, gear or toothed wheel 152. Attached to the pinion, gear or toothed wheel 152 is a driving shaft 162. A spring 170 appropriately surrounds the driving shaft 162 and is anchored to gear and rotatable connector 165 rotatably mounted on shaft 162. The actuator arm 185 captures the connector 165 and is suitably anchored to shaft 162 by fasteners such as set screws 182.

Figure 4:
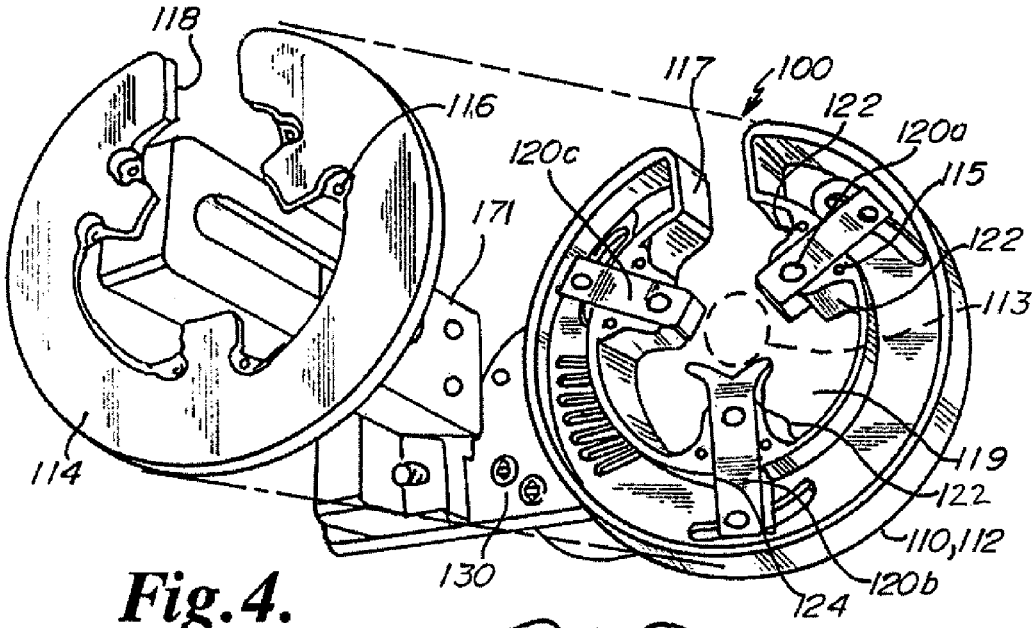
FIG. 4 is an exploded view of the rotating portion of the arrow rest of the present invention.

FIG. 4 illustrates additional details of the arrow rest 100 of the present invention. The support housing 110 further preferably comprises a hollow circular base 112 and a cover 114. The cover 114 is attached to the base 112 suitably by fasteners (not shown) engaging apertures 115, 116 in the base 112 and cover 114, respectively. The cover 114 and base 112 also further comprise arrow-receiving slots or gaps 118 and 117. A central opening 119 is surrounded by support housing 110.

Still examining FIG. 4, additional details of the operating mechanism may be appreciated. Support fingers 120*a*, 120*b*, and 120*c* (or a different number of support fingers) move radially within the base 112 toward a central axis 113 of the base 112 within central opening 119. To facilitate this motion, inwardly-directed projections 122 guide the support fingers 120*a*, 120*b*, 120*c*, preferably by slots, guides, or channels 124 therein (also in FIG. 7). One of the support fingers 120 (here finger 120*b*), may further preferably comprise a saddle 126 which supports the arrow 50 from falling away from fingers 120*a*, 120*b* and 120*c* when the bow 10 and arrow 50 are at rest (best seen in FIGS. 5 and 5A).

Figure 5:
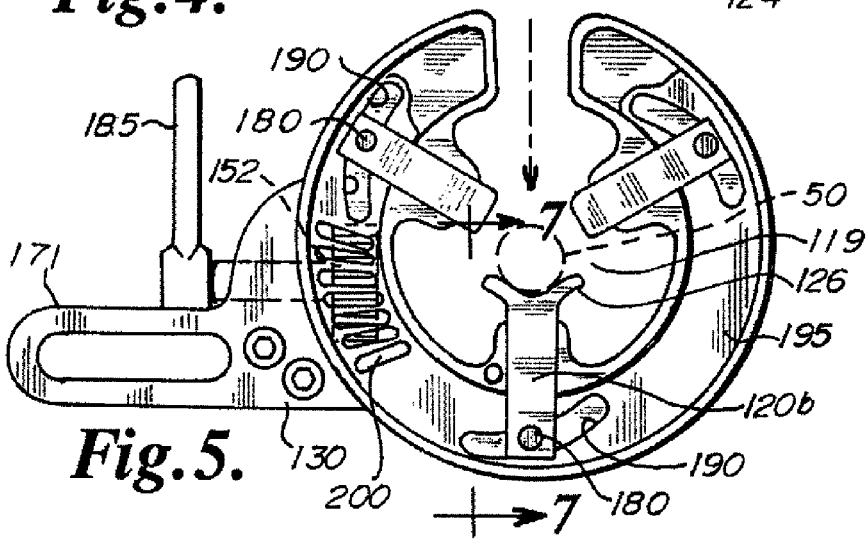
FIG. 5 is a front elevational view of the rotating portion of the present invention, with the arrow rest in the relaxed position, supporting an arrow thereon.

Turning to FIG. 5, the internal structure of the support housing 110 may be further appreciated. The support fingers 120 further comprise pins 180 which are slidingly engaged in cam slots 190 in slide plate 195 rotatably fitted within the base 112 of the support housing 110 suitably lubricated with grease. It will be appreciated that as the pins 180 slide along in the cam slots 190, the pins are simultaneously forced within channels 124 inwardly and outwardly, toward and away from the central axis 113, because of the cam-shaped curvature of the slots 190, at the same time carrying the support fingers 120 with them. As further explained below, the pins 180 are moved within the slots 190 by rotation of the slide plate 195.

Figure 5A:
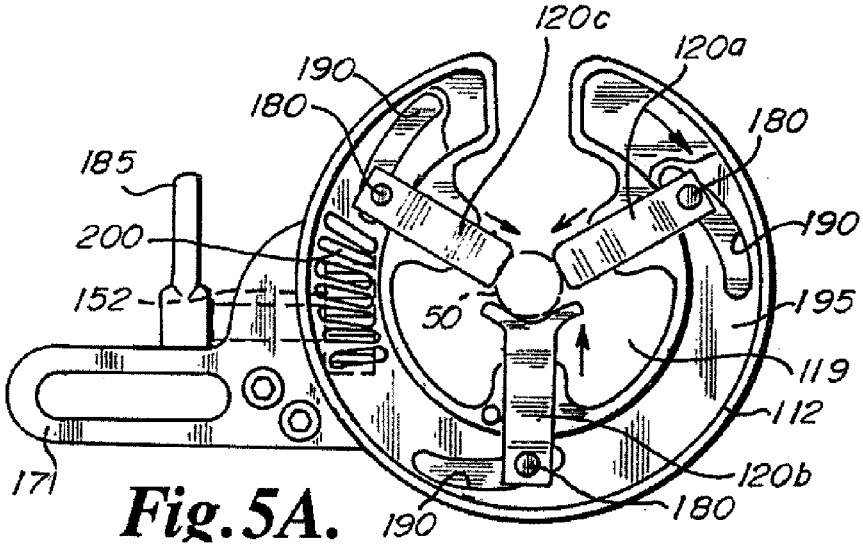
FIG. 5A is similar to FIG. 5, but shows the arrow rest in the fully extended position (full draw), supporting an arrow around 360 degrees.
Figure 6:
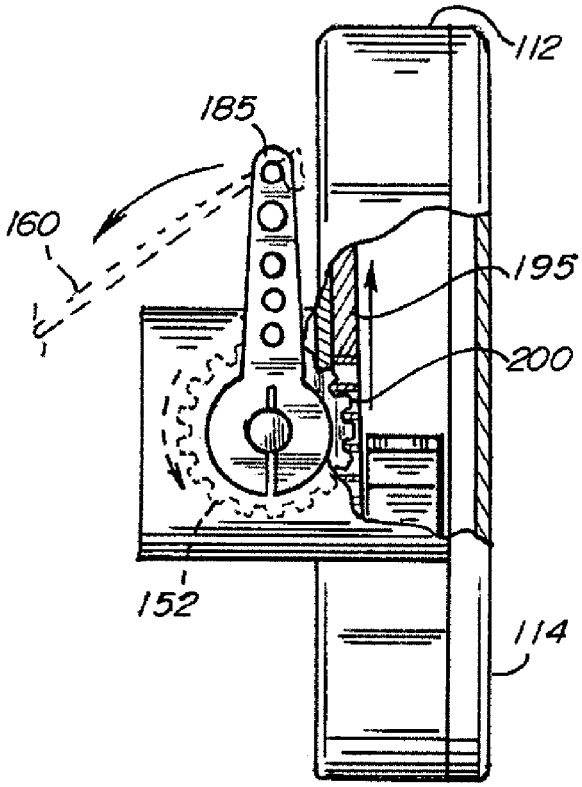
FIG. 6 is a side elevational view of the arrow rest in the relaxed position, with some structure cut away to show internal structure.
Figure 7:
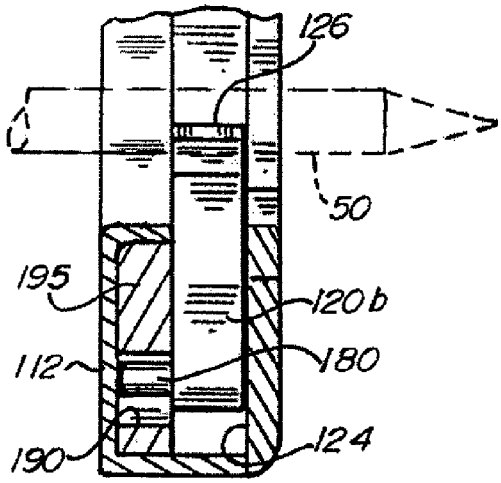
FIG. 7 is a cross-section taken at approximately the lines 7 of FIG. 5.

Rotation of the slide plate 195, as shown by the arrow in FIG. 5A, may be accomplished in any suitable way. In the preferred embodiment, cut-outs or rack 200 in the slide plate 195 receive teeth of the pinion gear 152, which is shown in phantom in FIGS. 5 and 5A. As the gear or toothed wheel 152 is turned by actuator arm 185, its teeth engage the cut-outs or rack 200, which in turn causes the slide plate 195 to rotate within the base 112. The spring 170 biases the plate 195 so that the pins 180 are held within the slots 190 at the position shown in FIG. 5 so that the support fingers 120 are retracted away from the central axis 113, as shown in FIG. 5. When the plate 195 is rotated in the direction shown by the arrow in FIG. 5A, the slots 190 move along the pins 180, forcing the support fingers inwardly toward the central axis 113, as shown by the inwardly directed arrows. FIGS. 6 and 7 show additional structural details. The actuator link or string 160 is connected to the actuator arm or lever 185 in any appropriate manner, but suitably through one of the appropriate actuator arm apertures 187. Rack 200 and pinion gear 152 are clearly visible here also.

Figure 8:
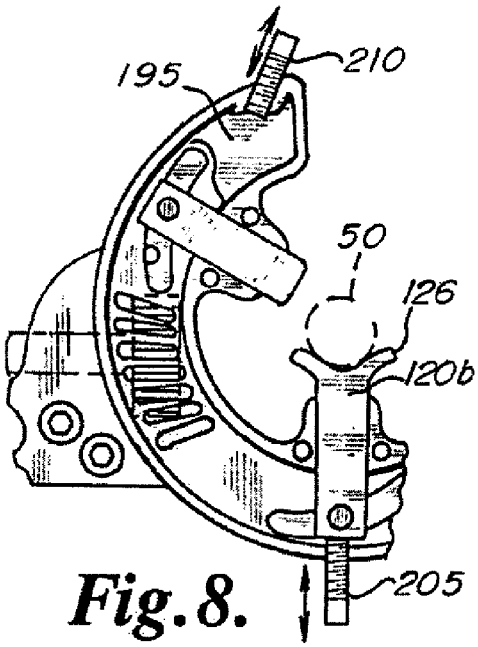
FIG. 8 is similar to FIG. 5, but shows a second embodiment of the present invention.
Figure 9:
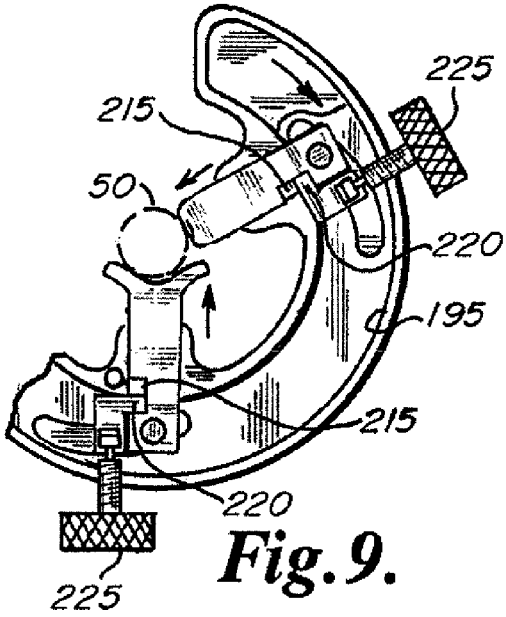
FIG. 9 is similar to FIG. 5A, but shows a third embodiment of the present invention.

FIGS. 8 and 9 illustrate two different embodiments of fine adjustment or limiter mechanisms to adjust the operation of the arrow rest 100 for different diameter arrows 50. In FIG. 8, a set screw 205 may be provided to engage the support finger 120*b* which has the saddle 172 in order to adjust the height of the arrow 50 in the relaxed position of the rest. This adjustment will lessen the chance of arrow 50 falling off saddle 126 in the rest position. Set screw 210 may be provided to limit the rotation of the plate 195, which in turn will limit the inward travel of the support fingers 120. FIG. 9 illustrates a second embodiment in which one or more of the support fingers 120 has a notch or groove 215. An arm 220 engages this notch or groove 215. The position of the arm 220 within the notch or groove 215 may be adjusted by a thumb screw 225, adjusting the limit of travel of the support fingers 120 inwardly and outwardly.

Operation of the arrow rest of the present invention will now be described.

When the archer desires to shoot an arrow 50, the archer fits the arrow into the rest through the arrow receiving slot 117, 118, as shown by the downwardly pointing dashed arrow in FIG. 5. The arrow 50 then rests upon the saddle 126 or bottom support finger 1206. As the archer draws back the bowstring 40 to full draw as shown in FIG. 1, movement of the cable 40*b* causes the actuator link 160 to pull on the actuator arm 185. This in turn causes movement of the pinion gear or toothed wheel 152. Movement of the gear 152 against the rack 200 in the rotating slide plate 195 causes the guide pins 180 to move along the guide cam slots 190. As the guide pins 180 move along the guide cam slots 190 to the position shown in FIG. 5A, the support fingers 120 are simultaneously forced inward toward the central axis 113, encompassing, trapping, holding and containing the arrow 40 about 360 degrees of the circumference of the arrow shaft. Once the bowstring has been drawn back to full draw, the orientation of the bow can be changed from vertical to horizontal without any risk of the arrow falling out of the rest.

When the archer releases the bowstring 40, the actuator link 160 loses its tension against the actuator arm 185. The spring 170 then causes the gear 152 to rapidly rotate the rotating slide plate 195 in the opposite direction, causing the guide pins 180 to move back along the guide cam slots 190 and outwardly from the arrow. The support fingers 120 then fully retract, allowing passage of the arrow shaft and fletching without interference. The spring 170 prevents any recoil in the mechanism from causing the support fingers to rebound into the path of the arrow.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described below. All publications, patent applications, patents, and other references mentioned herein are incorporated by reference in their entirety to the extent allowed by applicable law and regulations. In case of conflict, the present specification, including definitions, will control.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A retracting containment arrow rest for arrows used with an archery bow with a riser, bowstring and cable, comprising:

(a) a support housing mountable to the bow riser, the housing having a central opening and an arrow slot for receiving the arrow into the central opening, and (b) at least three fingers movably mounted within the housing and extending inwardly into the central opening adapted to radially move inward substantially in one plane to lift and capture the arrow along a central axis of the central opening when the bow is drawn and to move radially outward away from the arrow when the bow is fired (c) a rotatable slide plate with cam surfaces within the housing to support and radially move the fingers, (d) a rack on the slide plate and a pinion gear engageable with the rack for rotating the slide plate, and (e) an external actuator arm connected to the gear, the activator arm connected to the bow as to rotate the gear when the bow is drawn to firing position.

2. The retracting containment arrow rest of claim 1 wherein the fingers are 120 degrees apart.

3. The retracting containment arrow rest of claim 1, wherein one of the fingers is vertically oriented at the bottom of the central opening to support the arrow at rest from below.

4. The retracting containment arrow rest of claim 3, where the bottom finger has a saddle at its upper portion for supporting the arrow.

5. The retracting containment arrow rest of claim 1 wherein the housing is cylindrical and hollow with inward channels directed into the central opening to support the radially movable fingers.

6. A retracting containment arrow rest for arrows used with an archery bow with a riser, bowstring and cable, comprising:

(a) a support housing mountable to the bow riser, the housing having a central opening and an arrow slot for receiving the arrow into the central opening, and (b) at least three fingers movably mounted 120 degrees apart within the housing and extending inwardly into the central opening adapted to radially move inward substantially in one plane to lift and capture the arrow along a central axis of the central opening when the bow is drawn and to move radially outward away from the arrow when the bow is fired, wherein one of the fingers is vertically oriented at the bottom of the central opening to support the arrow at rest from below and has a saddle at its upper portion for supporting the arrow (c) a rotatable slide plate with cam surfaces within the housing to support and radially move the fingers, (d) a rack on the slide plate and a pinion gear engageable with the rack for rotating the slide plate, and (e) an external actuator arm connected to the gear, the activator arm connected to the bow as to rotate the gear when the bow is drawn to firing position.

7. The retracting containment arrow rest of claim 6 wherein the housing is cylindrical and hollow with inward channels directed into the central opening to support the radially movable fingers.

* * * * *